US005106279A

United States Patent [19]

Richardson, Jr.

[11] Patent Number: 5,106,279

[45] Date of Patent: Apr. 21, 1992

[54] ORBITING SCROLL MEMBER ASSEMBLY

[75] Inventor: Hubert Richardson, Jr., Brooklyn, Mich.

[73] Assignee: Tecumseh Products Company, Tecumseh, Mich.

[21] Appl. No.: 649,894

[22] Filed: Feb. 4, 1991

[51] Int. Cl.[5] ..... F04C 18/04

[52] U.S. Cl. ..... 418/55.2; 418/55.4; 418/55.5; 418/55.6; 418/57

[58] Field of Search ..... 418/55.2, 55.4, 55.5, 418/55.6, 57

[56] References Cited

U.S. PATENT DOCUMENTS

| | | | |
|---|---|---|---|
| 3,600,114 | 8/1971 | Dvorak et al. | 418/55.5 |
| 3,874,827 | 4/1975 | Young | 418/57 |
| 3,884,599 | 5/1975 | Young et al. | 417/55.5 |
| 3,924,977 | 12/1975 | McCullough | 418/57 |
| 4,300,875 | 11/1981 | Fischer et al. | 418/56 |
| 4,365,941 | 12/1982 | Tojo et al. | 417/372 |
| 4,600,369 | 7/1986 | Blain | 418/57 |
| 4,611,975 | 9/1986 | Blain | 418/5 |
| 4,708,607 | 11/1987 | Hayano et al. | 418/55.5 |
| 4,743,181 | 5/1988 | Murayama et al. | 418/55.5 |
| 4,767,293 | 8/1988 | Caillat et al. | 418/57 |
| 4,993,928 | 2/1991 | Fraser, Jr. | 418/55.5 |

FOREIGN PATENT DOCUMENTS

| | | | |
|---|---|---|---|
| 54-124310 | 9/1979 | Japan | 418/55.5 |
| 59-79091 | 5/1984 | Japan | 418/55.5 |
| 61-8407 | 1/1986 | Japan . | |

*Primary Examiner*—John J. Vrablik
*Attorney, Agent, or Firm*—Baker & Daniels

[57] ABSTRACT

An orbiting scroll member of a hermetic scroll-type compressor, including a scroll plate, a drive plate, and connecting pins coupling the two plates together in a manner permitting axial separation therebetween. A seal is unattachedly retained intermediate the scroll plate and the drive plate by a groove formed in the scroll plate. The seal extends out of the groove toward the drive plate to slidingly seal thereagainst. The seal defines fixed radially inner and outer portions of the scroll plate that are exposed to oil at discharge pressure and refrigerant at suction pressure, thereby imparting an axial compliance force. In one embodiment, the orbiting scroll plate is permitted to move transversely relative to the drive plate, by virtue of loose-fitting connecting pins, thereby facilitating radial compliance.

10 Claims, 3 Drawing Sheets

ORBITING SCROLL MEMBER ASSEMBLY

BACKGROUND OF THE INVENTION

The present invention relates generally to a hermetic scroll-type compressor and, more particularly, to such a compressor having fixed and orbiting scroll members, wherein a compliance mechanism acts on the orbiting scroll plate to bias it axially and radially toward the fixed scroll member for proper mating and sealing therebetween.

A typical scroll compressor comprises two facing scroll members, each having an involute wrap, wherein the respective wraps interfit to define a plurality of closed compression pockets. When one of the scroll members is orbited relative to the other, the pockets decrease in volume as they travel between a radially outer suction port and a radially inner discharge port, thereby conveying and compressing the refrigerant fluid.

It is generally believed that the scroll-type compressor could potentially offer quiet, efficient, and low-maintenance operation in a variety of refrigeration system applications. However, several design problems persist that have prevented the scroll compressor from achieving wide market acceptance and commercial success. For instance, during compressor operation, the pressure of compressed refrigerant at the interface between the scroll members tends to force the scroll members axially apart. Axial separation of the scroll members causes the closed pockets to leak at the interface between the wrap tips of one scroll member and the face surface of the opposite scroll member. Such leakage causes reduced compressor operating efficiency and, in extreme cases, can result in an inability of the compressor to operate.

Leakage between compression pockets of a scroll compressor may also occur at those locations where the wrap walls sealingly contact each other to define the moving compression pockets. Specifically, the pressure of the compressed refrigerant in the compression pockets, together with manufacturing tolerances of the component parts, may cause slight radial separation of the scroll members and result in the aforementioned leakage.

Efforts to counteract the separating forces applied to the scroll members during compressor operation, and thereby minimize the aforementioned leakages, have resulted in the development of several prior art compliance schemes. With respect to axial compliance mechanisms, it is known to axially preload the scroll members toward each other with a force sufficient to resist the dynamic separating force. However, this approach results in high initial frictional forces between the scroll members and/or bearings when the compressor is at rest, thereby causing difficulty during compressor startup. Another prior art approach involves assuring close manufacturing tolerances for component parts and having the separating force borne by a thrust bearing. This approach not only requires an expensive thrust bearing, but also involves high manufacturing costs in maintaining close machining tolerances.

A number of prior art patents disclose a scroll-type compressor design in which an intermediate pressure chamber is provided behind the orbiting scroll member, whereby the intermediate pressure creates an upward force to oppose the separating force. Such a design recognizes the fact that suction pressure behind the orbiting scroll member is insufficient to oppose the separating force, while discharge pressure behind the orbiting scroll member results in too great an upward force causing rapid wear of the scroll wraps and faces. However, establishing an intermediate pressure between suction pressure and discharge pressure requires that an intentional leak be introduced between an intermediate pressure pocket and a discharge pressure region. Such a leak results in less efficient operating conditions for the compressor.

Several other prior art scroll compressor designs, directed to controlling the upward force on the orbiting scroll member to oppose the separating force, have utilized a combination of gaseous refrigerant at suction pressure and gaseous refrigerant at discharge pressure for exposure to respective areas on the backside of the orbiting scroll member. In such compressor designs, various seal means have been utilized to separate the respective gaseous pressure regions. For instance, it is known to utilize an annular seal element intermediate the bottom surface of the orbiting scroll member and an adjacent fixed frame member, whereby the seal element extends toward and slidingly seals against the bottom surface. A problem with such a seal arrangement is that the relative orbiting motion of the scroll member with respect to the seal element changes the axial force distribution on the scroll member, thereby generating an unwanted moment. Also the seal may undergo additional wear if it has to support sealing functions in the axial and radial directions at the same time.

Another axial compliance mechanism for a scroll compressor involves respective regions of the orbiting scroll member bottom surface exposed to oil at discharge pressure and refrigerant fluid at suction pressure. The regions are sealingly separated by a flexible annular seal element that is disposed between the orbiting scroll member bottom surface and a rotating thrust surface comprising a radially extending plate portion of a drive crankshaft.

Radial compliance of the scroll members toward one another, whereby sealing between respective wrap walls is promoted, has typically been accomplished by a swing-link drive mechanism that couples the orbiting scroll member to the drive shaft. While satisfactory results have been achieved with such a mechanism, substitution of a radial compliance mechanism not associated with the drive function would simplify the compressor design, thereby improving manufacturability.

Another method of practicing radial compliance involves a two-piece orbiting scroll design, wherein a separate wrap member is loosely connected to a plate member, thereby allowing the wrap to move slightly in the radial direction. A problem with this design is that a sliding interface between the base of the wrap member and the surface of the plate member is a potential location for leakage between compression pockets.

The present invention is directed to overcoming the aforementioned problems associated with scroll-type compressors, wherein it is desired to provide both axial and radial forces on the orbiting scroll member to facilitate sealing and prevent leakage between the interfitting scroll members.

SUMMARY OF THE INVENTION

The present invention overcomes the disadvantages of the above-described prior art scroll type compressors by providing an improved axial compliance mechanism capable of applying a net axial force on the back surface of an orbiting scroll while also creating radial compliance with a cooperating fixed scroll member, to resist the tendency of the scroll members to axially and radially separate.

Generally, the invention provides a scroll member assembly for use as an orbiting scroll member in a scroll-type compressor. The assembly includes a scroll plate having a back surface and a face surface from which an involute wrap upwardly extends. A separate drive plate includes a mounting surface and a hub surface. The back surface of the scroll plate is coupled to the mounting surface of the drive plate so as to permit axial and movement of the scroll plate and drive plate relative one another. A substantially sealed chamber is defined intermediate the scroll plate and the drive plate, for causing axial separation of the scroll plate and drive plate relative one another in response to pressurized oil being introduced in the chamber.

In one form of the invention, the scroll plate is coupled to the drive plate in a manner permitting both axial and radial movement of the scroll plate and drive plate relative one another. Accordingly, the orbiting scroll assembly of the present invention is capable of practicing both axial and radial compliance with a mating fixed scroll member.

An advantage of the scroll compressor of the present invention, according to one form thereof, is that of incorporating both axial and radial compliance mechanisms into one assembly, thereby simplifying the compressor design.

Another advantage of the scroll compressor of the present invention is that sealing between respective portions of the orbiting scroll plate exposed to discharge and suction pressure is accomplished while allowing for a fixed location of the respective portions during orbiting motion of the scroll member.

A further advantage of the scroll compressor of the present invention is that of achieving radial compliance of the orbiting wrap without using a swing-link configuration.

Another advantage of the scroll compressor of the present invention is that axial forces applied to the orbiting scroll plate, for the purpose of axial compliance of the orbiting scroll plate toward the fixed scroll member, are substantially identical throughout orbiting motion of the scroll member, thereby reducing undesirable moments with respect to the orbiting scroll member central axis.

Yet another advantage of the scroll compressor of the present invention, in accordance with one form thereof, is that sealing between respective portions of the orbiting scroll plate exposed to discharge and suction pressure is enhanced by the discharge pressure present at the interface between pressure regions rather than requiring an additional source of discharge pressure.

Another advantage of the scroll compressor of the present invention is that the life of the seal member separating discharge and suction pressures on the back surface of the orbiting scroll member is increased.

A still further advantage of the scroll compressor of the present invention is the provision of a simple, reliable, inexpensive, and easily manufactured compliance mechanism for producing a substantial force on the orbiting scroll plate toward the fixed scroll member.

The invention, in one form thereof, provides a scroll member assembly for use as an orbiting scroll member in a scroll-type compressor. The scroll member assembly includes a scroll plate with an involute wrap attached thereon, and a drive plate with a mounting surface and hub surface. Spaced along the back surface of the scroll plate is a mechanism to couple the scroll plate and drive plate. Specifically, there is a plurality of axial bores in the back surface of the scroll plate, and a corresponding plurality of axial bores in the mounting surface of the drive plate. Each one of the plurality of axial bores in the scroll plate is axially aligned with a respective one of the plurality of axial bores in the drive plate. A plurality of pins members are each received within a respective bore in the scroll plate and a corresponding respective bore in the drive plate.

In accord with one aspect of the previously described form of the present invention, either the bores in the scroll plate or the bores in the drive plate are oversized with respect to the pins members received therein. Consequently, the scroll plate is movable with respect to the drive plate in the axial and radial directions. In this manner radial and axial compliance of the orbiting scroll member assembly with a cooperating fixed scroll member in a compressor application is achieved.

According to a further aspect of the invention, a mechanism for sealing between the scroll and drive plates is provided. Specifically, the sealing mechanism includes an annular seal groove on the back surface of the scroll plate and an annular seal element unattachedly retained therein. This seal element permits oil at compressor discharge pressure to substantially fill the space between the scroll plate and drive plate. Consequently, the scroll plate and drive plate forced axially apart, permitting axial compliance of the scroll plate with the other cooperating scroll member.

DESCRIPTION OF THE PREFERRED EMBODIMENT

Figure 1:
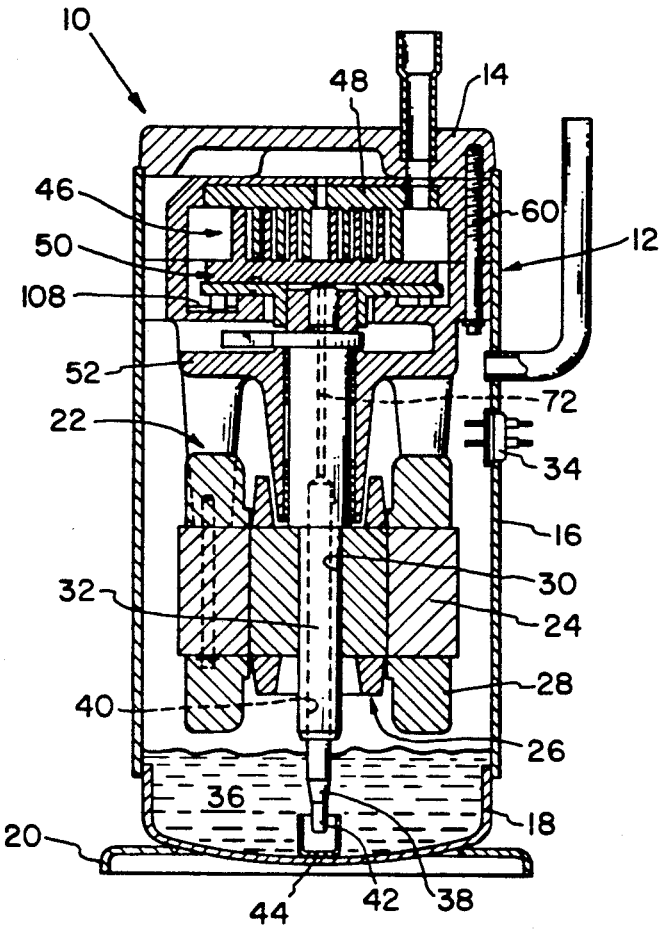
FIG. 1 is a longitudinal sectional view of a compressor of the type to which the present invention pertains.
Figure 2:
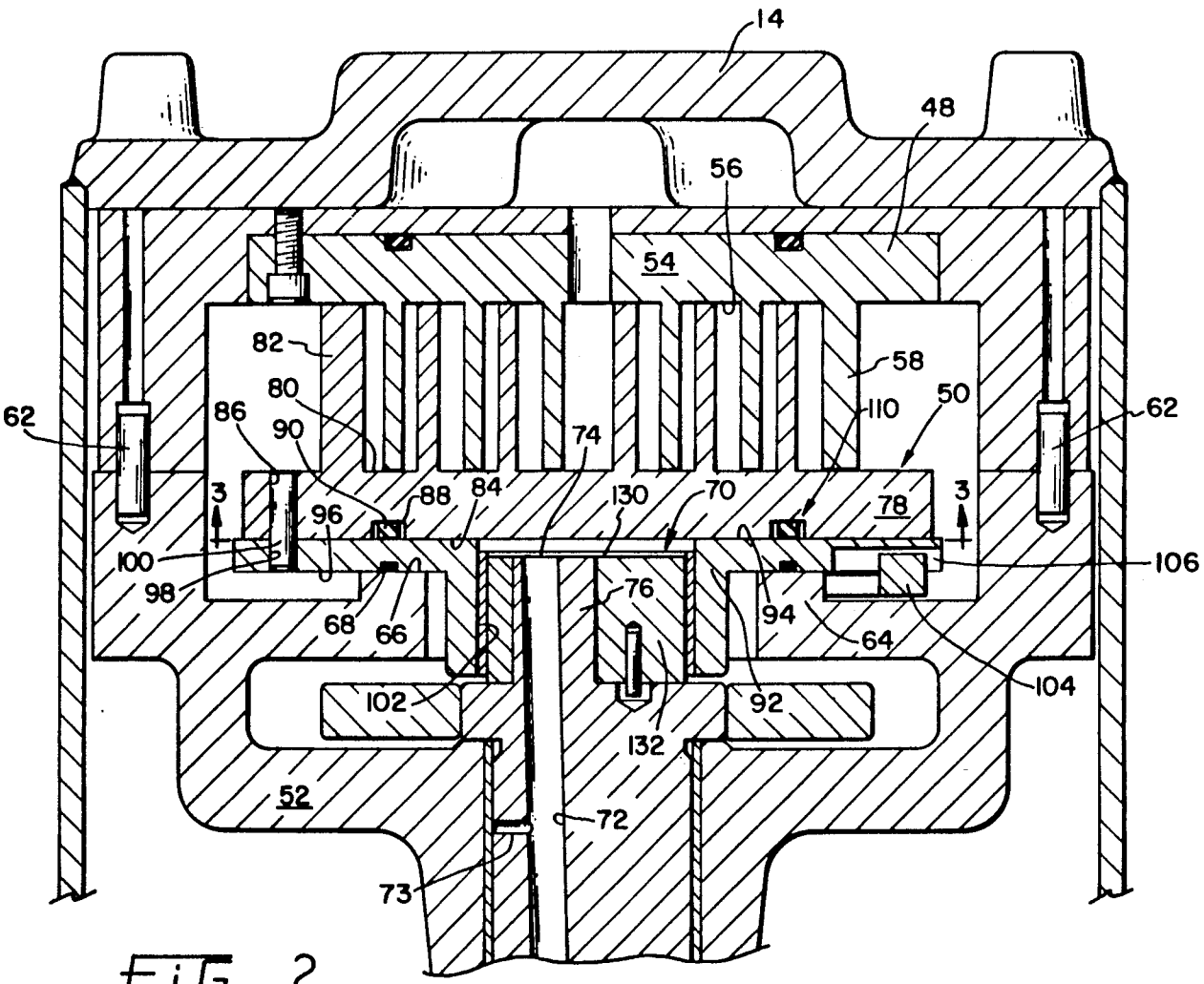
FIG. 2 is an enlarged fragmentary sectional view of the compressor of FIG. 1, particularly showing the orbiting scroll member assembly of the present invention.

Referring now to FIGS. 1 and 2, there is shown a compressor 10 having a housing generally designated at 12. The housing has a top cover plate 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the compressor in a vertically upright position.

Located within hermetically sealed housing 12 is an electric motor generally designated at 22, having a stator 24 and a rotor 26. Stator 24 is provided with windings 28. Rotor 26 has a central aperture 30 provided therein into which is secured a crankshaft 32 by an interference fit. A terminal cluster 34 is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extends downwardly into the open end of a cylindrical oil cup 44, which provides a quiet zone from which high quality, non-agitated oil is drawn.

A scroll compressor mechanism 46 is enclosed within housing 12, and generally comprises a fixed scroll member 48, an orbiting scroll member assembly 50, and a main bearing frame member 52. Orbiting scroll assembly 50 is prevented from rotating about its own axis by means of a conventional Oldham ring assembly, comprising an Oldham ring 104, and Oldham key pairs 106, 108 associated with orbiting scroll member 50 and frame member 52, respectively. Orbiting scroll member assembly 50, in accordance with the present invention, will be more fully described hereinafter.

Fixed scroll member 48 comprises a generally flat face plate 54 having a face surface 56, and an involute fixed wrap 58 extending axially from surface 56. Fixed scroll member 48 and frame member 52 are secured together and are attached to top cover plate 14 by means of a plurality of mounting bolts 60, as shown in FIG. 1. Precise alignment between fixed scroll member 48 and frame member 52 is accomplished by a pair of locating pins 62, as shown in FIG. 2. Frame member 52 includes an annular, radially inwardly projecting portion 64, having an axially upwardly facing stationary thrust surface 66 adjacent orbiting scroll member assembly 50. An annular seal 68 is operably disposed between stationary thrust surface 66 and orbiting scroll member assembly 50, thereby sealing between a radially inner discharge pressure and a radially outer suction pressure.

A lubrication system for compressor 10 provides lubricating oil from oil sump 36 to the scroll members 48 and 50, crankshaft 32, and crank mechanism 70. Specifically, an axial oil passageway 72 is provided in crankshaft 32, which communicates with tube 38 and extends upwardly through crankshaft 32 to an opening 74 on the top of an eccentric crankpin 76 at the top of crankshaft 32. A radial oil passage 73 delivers oil from axial oil passage 72 to the bearing portion of main frame 52.

In accordance with one embodiment of the present invention, orbiting scroll assembly 50 comprises a generally flat orbiting scroll plate 78, including a face surface 80 having an involute wrap 82 thereon and a back surface 84. Back surface 84 includes a plurality of axial holes 86 and an annular seal groove 88. An annular seal element 90 is partially disposed within annular groove 88. The orbiting scroll assembly also includes a drive plate 92 having a mounting surface 94 and a hub surface 96. Mounting surface 94 has a plurality of axial holes 98 corresponding to axial holes 86 of back surface 84. Scroll plate 78 and drive plate 92 are coupled together by a plurality of connecting pins 100 received within axial holes 86 and 98.

The connecting pins 100 are slidingly received in either the scroll plate 78 or drive plate 92, to allow axial movement of scroll plate 78 relative to drive plate 92. In the disclosed embodiments of the invention, a pair of connecting pins 100 have one of their ends press fit into a corresponding pair of axial holes 86 at diametrically opposed locations on scroll plate 78. The other ends of the pins extend upwardly from mounting surface 94 and are slidingly (FIG. 2) or loose fittingly (FIG. 6) received into a corresponding pair of axial holes 98. Drive plate 92 includes a hub surface 96 that defines a cylindrical well 102, as shown in FIG. 2.

Radial compliance of the orbiting scroll member assembly 50, in accordance with the embodiment of FIG. 2, is achieved through the use of an eccentric crank mechanism 70 situated on the top of crankshaft 32. Crank mechanism 70 comprises a conventional swing-link mechanism including a cylindrical roller 132 and eccentric crankpin 76, whereby roller 132 is eccentrically journalled about eccentric crankpin 76. As previously described, drive plate 92 of orbiting scroll assembly 50 includes a cylindrical well 102 into which roller 132 is received. This arrangement allows the orbiting scroll assembly 50 to be moved into radial compliance with the fixed scroll member 48.

Figure 3:
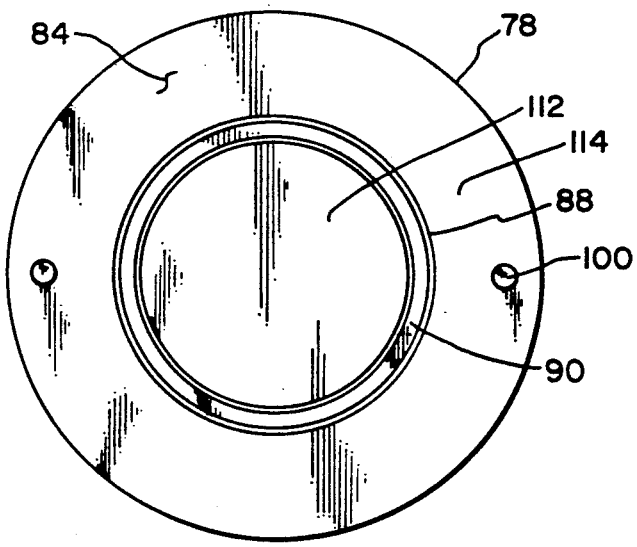
FIG. 3 is an enlarged bottom view of the scroll plate of the orbiting scroll member assembly of the compressor of FIG. 1, taken along the line 3—3 in FIG. 2 and viewed in the direction of the arrows.

The axial compliance mechanism of compressor 10 will now be further described with reference to FIGS. 3–5. Generally, a circular central portion of back surface 84 is exposed to discharge pressure, thereby providing a substantially constant force distribution acting upwardly upon orbiting scroll plate 78 toward fixed scroll member 48. Consequently, moments about the central axis of orbiting scroll plate 78 are minimized. More specifically, an annular seal mechanism 110, cooperating between back surface 84 and adjacent drive plate 92, sealingly separates between a radially inner portion 112 and a radially outer portion 114 of back surface 84, which are exposed to discharge pressure and suction pressure, respectively. As will be further explained herein, seal mechanism 110 includes an annular seal groove 88 formed in back surface 84.

Figure 4:
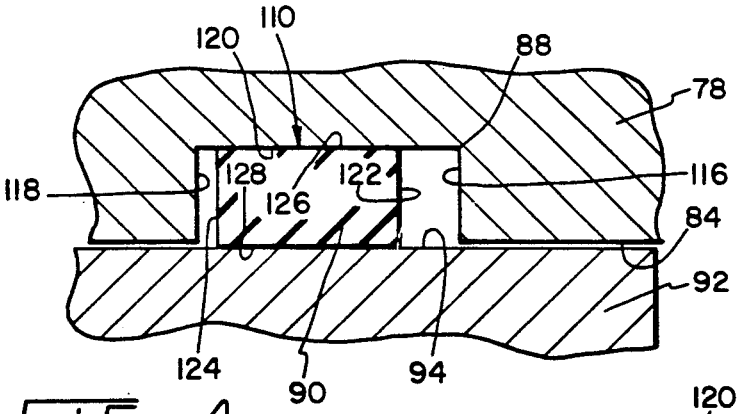
FIG. 4 is an enlarged fragmentary sectional view of the annular seal element of the orbiting scroll member assembly of the compressor of FIG. 1, shown in a non-actuated state.
Figure 5:
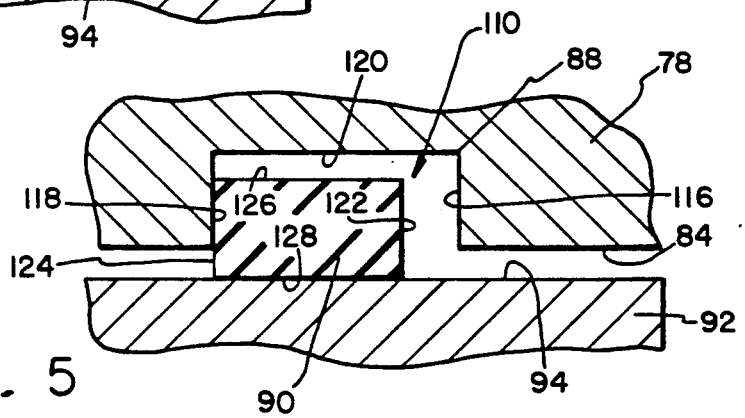
FIG. 5 is an enlarged fragmentary sectional view of the annular seal element of the orbiting scroll member assembly of the compressor of FIG. 1, shown in an actuated state.

In accordance with the embodiment of FIG. 4, seal mechanism 110 comprises an annular elastomeric seal element 90 unattachedly received within seal groove 88. In the preferred embodiment, the radial thickness of seal element 90 is less than the radial width of seal groove 88, as best shown in FIGS. 4 and 5. Referring to FIG. 4, annular seal groove 88 includes a radially inner wall 116, a radially outer wall 118, and a bottom wall 120 extending therebetween. Likewise, annular seal element 90 is generally rectangular and includes a radially inner surface 122, a radially outer surface 124, a top surface 126, and a bottom surface 128. In its unactuated condition shown in FIG. 4, seal element 90 has a diameter less than the diameter of outer wall 118, whereby outer surface 124 is slightly spaced from outer wall 118.

Axial compliance of orbiting scroll plate 78 toward fixed scroll member 48 occurs as the compressor compresses refrigerant fluid and causes the interior of housing 12 to pressurize to discharge pressure. Oil pickup tube 38 draws lubricating oil at discharge pressure from oil sump 36 and causes the oil to move upwardly through oil passageway 72. Referring now to FIG. 2, oil pumped upwardly through offset oil passageway 72 exits crankshaft 32 through opening 74 located on the top of eccentric crankpin 76. Lubricating oil delivered from hole 74 fills a substantially sealed chamber 130 within well 102, defined by back surface 84 and top surface of crank mechanism 70 including roller 132 and crankpin 76, and bounded by seal element 90.

The presence of oil at discharge pressure within chamber 130 causes scroll plate 78 to move axially away from drive plate 92, guided by connecting pins 100. The oil occupies the volume shown radially inwardly of seal element 90 in FIG. 4, thereby causing seal element 90 to expand radially outwardly and scroll plate 78 to move further axially upwardly away from drive plate 92, as shown in FIG. 5. As a result of the axial movement of scroll plate 78, increased space is created between back surface 84 and drive plate 92. Seal element 90 moves telescopingly downward toward drive plate 92 under the influence of gravity and/or a venturi effect created by the initial fluid flow between bottom surface 128 and drive plate 92. Consequently, oil at discharge pressure occupies the space between bottom wall 120 and top surface 126. From the foregoing, it will be appreciated that oil at discharge pressure acting on top surface 126 and inner surface 122 of seal element 90 creates a force distribution on the seal element 90 that urge it axially downwardly toward mounting surface 94 and radially outwardly toward outer wall 118 to seal thereagainst.

Figure 6:
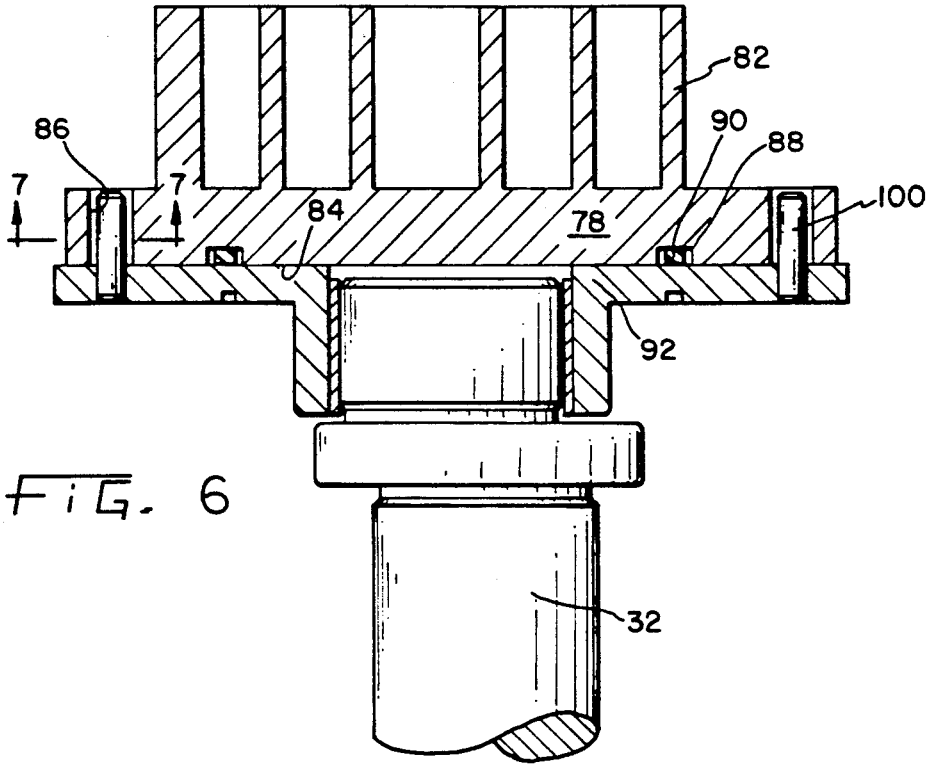
FIG. 6 is an enlarged fragmentary sectional view of a crankshaft and orbiting scroll member assembly, for incorporation in to the compressor of FIG. 1, in accordance with an alternative embodiment of the present invention.

Radial compliance of orbiting scroll member assembly 50 will now be discussed. As shown in FIG. 6, orbiting scroll member assembly 50 may be connected to a crankshaft 32 without a swing-link configuration as well as a crankshaft 32 with a swing link as shown in FIG. 2.

Radial compliance is accomplished by transverse movement of orbiting scroll plate 78, relative to drive plate 92, by virtue of the centripedal force of drive plate 92 transmitted to orbiting scroll plate 78 through connecting pins 100 received within axial holes 86.

Figure 7:
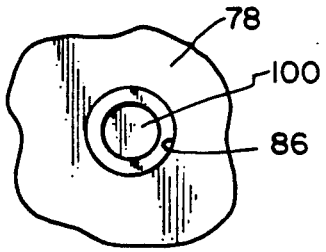
FIG. 7 is an enlarged fragmentary sectional view of the scroll member assembly of FIG. 6, taken along the line 7—7 in FIG. 6 and viewed in the direction of the arrows.

As the drive plate 92 non rotatingly orbits within compressor 10, scroll plate 78 attempts to follow the path of drive plate 92 by being dragged along orbitally by pins 100. The diameter of axial holes 86 are larger than the diameter of connecting pins 100 so that orbiting scroll can move transversely slightly from drive plate 92. Since the drive plate 92 is constantly changing its position in an orbiting relation, orbiting scroll plate 78 tends to move further radially than drive plate 92 by reasons of inertion until connector pins 100 force orbiting scroll plate 78 to move in a new direction. As shown in FIG. 7, pins 100 are loosely received in axial holes 86 on back surface 84. Connecting pins 100 allow orbiting scroll plate 78 to move in an axial direction without rotating.

It will be appreciated that seal mechanism 110, in accordance with the two embodiments described herein, provides a seal between respective fixed portions of back surface 84, which orbit along with orbiting scroll plate 78, whereby the upward force distribution on back surface 84 remains substantially constant throughout its orbiting motion. This is possible, in part, due to the ability of the seal configuration to slidingly seal against drive plate 92.

The provision of a stationary surface against which the seal configuration slidingly seals exhibits several noteworthy advantages. For instance, relative movement between the seal element 90 and sealing surfaces is minimized, thereby reducing frictional forces and increasing seal life. Additionally, leakage past the seal is more effectively controlled. It should also be noted that in the seal configuration described herein, leakage is minimized by the absence of seal mounting apparatus and complex multi-piece seal configurations.

The annular seal element 90 disclosed herein is preferably composed of a Teflon material. More specifically, a glass-filled Teflon, or a mixture of Teflon, Carbon, and Ryton is preferred in order to provide the seal element with the necessary rigidity to resist extruding into clearances due to pressure differentials. Furthermore, the surfaces against which the Teflon seal contacts are preferably cast iron.

It will be appreciated that the foregoing description of various embodiments of the invention is presented by way of illustration only and not by way of any limitation, and that various alternatives and modifications may be made to the illustrated embodiments without departing from the spirit and scope of the invention.

What is claimed is:

1. A scroll member assembly for use as an orbiting scroll member in a scroll-type compressor, comprising:

a scroll plate having a face surface and a back surface, said face surface having an involute wrap thereon;

a drive plate having a mounting surface and a hub surface;

coupling means for coupling said scroll plate to said drive plate with said back surface facing said mounting surface, said coupling means permitting axial movement of said scroll plate and said drive plate relative one another, said coupling means including a plurality of connecting pins, each pin having a first end received within a corresponding hole in said drive plate and a second end received within a corresponding hole in said scroll plate, one of said first and second ends of each of said plurality of connecting pins being received within its corresponding hole by an interference fit, and the other end being loosely received within its corresponding hole, thereby permitting transverse movement of said scroll plate relative said drive plate, whereby radial compliance may be accomplished;

seal means defining a substantially sealed chamber intermediate said back surface and said mounting surface for causing axial separation of said scroll plate and said drive plate relative one another in response to introduction of a pressurized fluid in said chamber; and passage means for introducing a pressurized fluid within said chamber.

2. The scroll member assembly of claim 1 in combination with a scroll-type compressor for compressing refrigerant fluid, said scroll-type compressor comprising:

a hermetically sealed housing having defined therein a discharge pressure chamber at discharge pressure and a suction pressure chamber at suction pressure;

a fixed scroll member operable intermeshed with said scroll member assembly;

a stationary frame member including a thrust surface adjacent said hub surface of said drive plate;

a crankshaft rotatably journalled by said frame member; and primary seal means, intermediate said hub surface of said drive plate and said thrust surface of said frame member, for sealingly separating between respective portions of said hub surface exposed to said discharge pressure chamber and said suction pressure chamber.

3. The scroll-type compressor of claim 2 in which:

said primary seal means comprises an annular primary seal groove formed in said hub surface of said drive plate, and an annular primary seal element partially disposed within said primary seal groove.

4. The scroll-type compressor of claim 3 in which:

said annular primary seal element is unattachedly retained within said annular primary seal groove and telescopingly extends axially from said primary seal groove toward said thrust surface of said frame member to slidingly seal thereagainst.

5. A scroll member assembly for use as an orbiting scroll member in a scroll-type compressor, comprising:

a scroll plate having a face surface and back surface, said face surface having an involute wrap thereon;

a drive plate having a mounting surface and hub surface;

a plurality of connecting pins extending between and being axially received within corresponding axially aligned holes in said scroll plate and said drive plate said holes in one of said plates being larger than said pins, such that said scroll plate is permitted to move axially and radially relative said drive plate;

an annular seal groove formed in said back surface of said scroll plate;

an annular seal element at least partially disposed within said seal groove and sealingly contacting against said back surface of said scroll plate to define a substantially sealed chamber intermediate said scroll plate and said drive plate; and a port extending through said drive plate to provide fluid communication between said sealed chamber and said hub surface of said drive plate, whereby pressured fluid may be introduced into said sealed chamber.

6. The scroll member assembly of claim 5 in which:

said annular seal element is unattachedly retained within said annular seal groove and telescopingly extends axially from said seal groove toward said mounting surface of said drive plate to slidingly seal thereagainst.

7. The scroll member assembly of claim 5 in which:

each of said plurality of connecting pins is loosely received within a respective one of said corresponding axially aligned holes in said scroll plate and said drive plate, thereby permitting transverse movement of said scroll plate relative said drive plate, whereby radial compliance may be accomplished.

8. The scroll member assembly of claim 5 in which:

said plurality of connecting pins comprises a pair of connecting pins extending between said scroll plate and said drive plate at diametrically opposed locations thereof.

9. The scroll member assembly of claim 5 in combination with a hermetic scroll compressor apparatus including a scroll compressor mechanism within a hermetically sealed housing, in which:

said compressor mechanism includes a drive means operably coupled to said hub surface of said drive plate for imparting orbiting motion to said scroll member assembly.

10. The hermetic scroll compressor apparatus of claim 9 in which:

said hermetically sealed housing includes therein an oil sump at discharge pressure; and said drive means includes a rotatable crankshaft, said crankshaft having oil passage means for supplying oil from said oil sump to said hub surface of said drive plate, whereby oil at discharge pressure is provided to said sealed chamber through said port in said drive plate.

* * * * *